US011689861B2

(12) United States Patent
Fan et al.

(10) Patent No.: US 11,689,861 B2
(45) Date of Patent: Jun. 27, 2023

(54) SOUND PRODUCTION DEVICE, DISPLAY DEVICE, AND TERMINAL

(71) Applicant: GUANGDONG OPPO MOBILE TELECOMMUNICATIONS CORP., LTD., Guangdong (CN)

(72) Inventors: Zehua Fan, Guangdong (CN); Zhijia Cui, Guangdong (CN); Le Yang, Guangdong (CN)

(73) Assignee: GUANGDONG OPPO MOBILE TELECOMMUNICATIONS CORP., LTD., Dongguan (CN)

( * ) Notice: Subject to any disclaimer, the term of this patent is extended or adjusted under 35 U.S.C. 154(b) by 58 days.

(21) Appl. No.: 17/559,072

(22) Filed: Dec. 22, 2021

(65) Prior Publication Data

US 2022/0116712 A1 Apr. 14, 2022

Related U.S. Application Data

(63) Continuation of application No. PCT/CN2020/097205, filed on Jun. 19, 2020.

(30) Foreign Application Priority Data

Jun. 28, 2019 (CN) ..... 201910579171.7

(51) Int. Cl.
*H04R 7/02* (2006.01)
*H04R 7/16* (2006.01)
*H04R 9/02* (2006.01)

(52) U.S. Cl.
CPC ..... *H04R 7/02* (2013.01); *H04R 7/16* (2013.01); *H04R 9/02* (2013.01); *H04R 2499/15* (2013.01)

(58) Field of Classification Search
CPC ..... H04R 2499/15; H04R 2499/11; H04R 1/028; H04R 1/025; H04R 2400/03; H04R 7/02; H04R 7/16; H04R 9/02
(Continued)

(56) References Cited

U.S. PATENT DOCUMENTS 8,301,188 B2 10/2012 Demuynck et al.
9,602,926 B1 3/2017 Keen et al.
(Continued)

FOREIGN PATENT DOCUMENTS

CN 101150884 A 3/2008
CN 101212824 A 7/2008
(Continued)

OTHER PUBLICATIONS

Extended European Search Report for EP Application 20831929.3 dated Jul. 15, 2022. (7 pages).
(Continued)

*Primary Examiner* — Norman Yu
(74) *Attorney, Agent, or Firm* — Young Basile Hanlon & MacFarlane, P.C.

(57) ABSTRACT

The present disclosure relates to a sound production device, a display device, and a terminal. The sound production device includes a first electrode layer arranged on a display substrate; an insulating layer arranged on a side of the first electrode layer away from the display substrate; an electromagnetic coil arranged on a side of the insulating layer away from the first electrode layer; a magnetic diaphragm arranged on a side of the electromagnetic coil away from the insulating layer and configured to vibrate and produce sounds in response to a magnetic field generated by the electromagnetic coil, wherein a vertical projection of the electromagnetic coil on the display substrate and a vertical projection of the magnetic diaphragm on the display sub-
(Continued)

strate falls on a non-opening area, the insulating layer defines a via, and the electromagnetic coil and the first electrode layer are electrically connected through the via.

20 Claims, 7 Drawing Sheets

(58) Field of Classification Search
USPC ..... 381/333, 398
See application file for complete search history.

(56) References Cited

U.S. PATENT DOCUMENTS

| | | | |
|---|---|---|---|
| 2009/0141916 A1 | 6/2009 | Clair et al. | |
| 2016/0014518 A1 | 1/2016 | Liu | |
| 2019/0004566 A1 | 1/2019 | Lee et al. | |
| 2020/0043991 A1* | 2/2020 | Noh | H04R 17/00 |

FOREIGN PATENT DOCUMENTS

| | | |
|---|---|---|
| CN | 101578686 A | 11/2009 |
| CN | 202142247 U | 2/2012 |
| CN | 203352639 U | 12/2013 |
| CN | 105142092 A | 12/2015 |
| CN | 106303858 A | 1/2017 |
| CN | 206835357 U | 1/2018 |
| CN | 108141674 A | 6/2018 |
| CN | 108156562 A | 6/2018 |
| CN | 108566602 A | 9/2018 |
| CN | 108616794 A | 10/2018 |
| CN | 109068249 A | 12/2018 |
| CN | 109218943 A | 1/2019 |
| CN | 109244108 A | 1/2019 |
| CN | 208314412 U | 1/2019 |
| CN | 109326236 A | 2/2019 |
| CN | 109445640 A | 3/2019 |
| CN | 109782471 A | 5/2019 |
| CN | 110267172 A | 9/2019 |
| EP | 2819433 A1 | 12/2014 |

OTHER PUBLICATIONS

Chinese Notification to Grant Patent Right for Invention with English Translation for CN Application 201910579171.7 dated Nov. 5, 2020. (9 pages).

Chinese First Office Action with English Translation for CN Application 201910579171.7 dated Jun. 28, 2020. (17 pages).

International Search Report with English Translation for PCT Application PCT/CN2020/097205 dated Sep. 1, 2020. (17 pages).

* cited by examiner

SOUND PRODUCTION DEVICE, DISPLAY DEVICE, AND TERMINAL

CROSS-REFERENCE TO RELATED APPLICATION(S)

The present disclosure is a continuation-application of International (PCT) Patent Application No. PCT/CN2020/097205 filed on Jun. 19, 2020, which claims foreign priority of Chinese Patent Application No. 201910579171.7, filed on Jun. 28, 2019, the entire contents of both of which are hereby incorporated by reference.

TECHNICAL FIELD

The present disclosure relates to the field of terminal producing sound technologies, and in particular, to sound production device, a display device and a terminal.

BACKGROUND

In-screen sound production technology refers to converting audio electrical signals into mechanical vibrations of a display screen through a sound exciter, producing sound waves through the mechanical vibrations to achieve a purpose of sound production, and combine an earpiece and the display screen to meet needs of a full screen of a terminal.

At present, in-screen sound production is mainly generated by setting an exciter under a screen and driving the screen to vibrate by the exciter. Due to a large package size of the exciter and a small space under the screen, an arrangement of the exciter is difficult, and a position of the exciter is limited, making it is impossible to perform full screen sound.

It should be noted that information disclosed above in the background is only used to enhance understanding of the background of the disclosure and may include information that does not constitute prior art known to those of ordinary skill in the art.

SUMMARY

The purpose of the present disclosure is to provide a sound production device, a display device and a terminal.

In a first aspect of the present disclosure, a sound production device for a display device is provided, the display device includes a display substrate. The display substrate has an opening area and a non-opening area. The sound production device includes a first electrode layer, an insulating layer, an electromagnetic coil, and a magnetic diaphragm. The first electrode layer is arranged on the display substrate. The insulating layer is arranged on a side of the first electrode layer away from the display substrate. The electromagnetic coil is arranged on a side of the insulating layer away from the first electrode layer. A vertical projection of the electromagnetic coil on the display substrate falls on the non-opening area. The insulating layer defines a via, and the electromagnetic coil and the first electrode layer are electrically connected through the via. The magnetic diaphragm is arranged on a side of the electromagnetic coil away from the insulating layer and configured to vibrate and produce sounds in response to a magnetic field generated by the electromagnetic coil. A vertical projection of the magnetic diaphragm on the display substrate falls on the non-opening area.

In a second aspect of the present disclosure, a display device is provided. The display device includes a display substrate having an opening area and a non-opening area and at least one sound production device. The at least one sound production device is arranged on the display substrate. Each of the at least one sound production device includes a first electrode layer, an insulating layer, an electromagnetic coil, and a magnetic diaphragm. The first electrode layer is arranged on the display substrate. The insulating layer is arranged on a side of the first electrode layer away from the display substrate. The electromagnetic coil is arranged on a side of the insulating layer away from the first electrode layer. A vertical projection of the electromagnetic coil on the display substrate falls on the non-opening area. The insulating layer defines a via, and the electromagnetic coil and the first electrode layer are electrically connected through the via. The magnetic diaphragm is arranged on a side of the electromagnetic coil away from the insulating layer, spaced apart from the electromagnetic coil and configured to vibrate and produce sounds in response to a magnetic field generated by the electromagnetic coil. A vertical projection of the magnetic diaphragm on the display substrate falls on the non-opening area.

In a third aspect of the present disclosure, a terminal is provided. The terminal includes a display device. The display device includes a display substrate and at least one sound production device. The terminal includes a display device. The display device includes a display substrate and at least one sound production device. The display substrate has an opening area and a non-opening area. The at least one sound production device is arranged on the display substrate. Each of the at least one sound production device includes a first electrode layer, an insulating layer, an electromagnetic coil, and a magnetic diaphragm. The first electrode layer is arranged on the display substrate. The insulating layer is arranged on a side of the first electrode layer away from the display substrate. The electromagnetic coil is arranged on a side of the insulating layer away from the first electrode layer. A vertical projection of the electromagnetic coil on the display substrate falls on the non-opening area. The insulating layer defines a via, and the electromagnetic coil and the first electrode layer are electrically connected through the via. The magnetic diaphragm is arranged on a side of the electromagnetic coil away from the insulating layer, spaced apart from the electromagnetic coil and configured to vibrate and produce sounds in response to a magnetic field generated by the electromagnetic coil. A vertical projection of the magnetic diaphragm on the display substrate falls on the non-opening area.

It should be understood that the above general description and the detailed description below are only exemplary and do not limit the present disclosure.

BRIEF DESCRIPTION OF DRAWINGS

The above and other objects, features and advantages of the present disclosure will become more apparent by describing exemplary embodiments in detail with reference to the drawings.

The drawings herein are incorporated into and form a part of the description, showing embodiments consistent with the present disclosure, and are used together with the description to explain the principles of the present disclosure. Apparently, the drawings described below are only for illustration, but not for limitation. It should be understood that, one skilled in the art may obtain other drawings based on these drawings, without making any inventive work.

Figure 1:
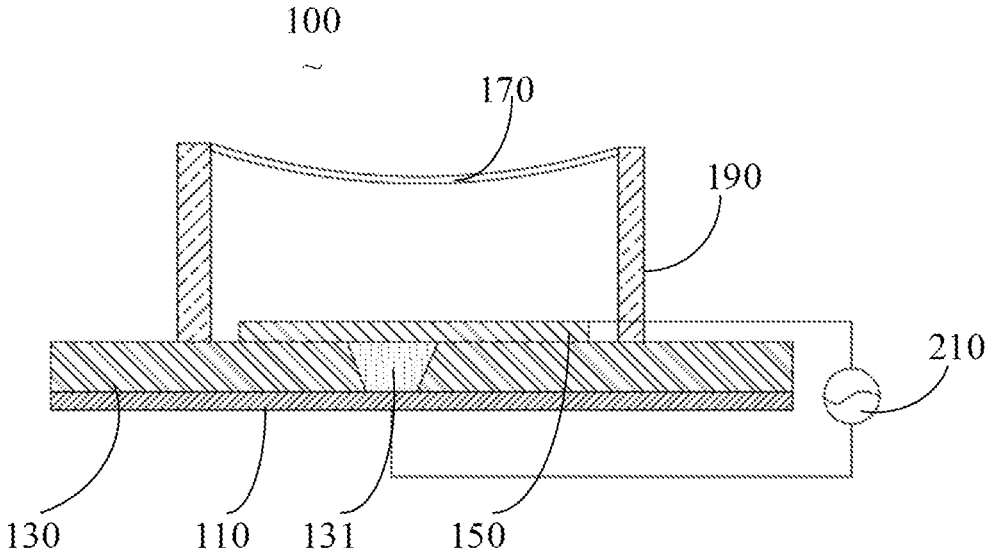
FIG. 1 is a structural schematic view of a sound production device provided by some embodiments of the present disclosure.

The labels in the drawings are described as follows:

100 refers to sound production device; 110 refers to first electrode layer; 130 refers to insulating layer; 150 refers to electromagnetic coil; 170 refers to magnetic diaphragm; 190 refers to diaphragm support; 200 refers to display substrate; 210 refers to sounding driving circuit; 211 refers to signal source; 212 refers to switch sub circuit; 230 refers to opening area; 250 refers to non-opening area; 251 refers to sound producing areas; 300 refers to diaphragm packaging layer; 400 refers to protective layer; 01 refers to terminal; 10 refers to display device.

DETAILED DESCRIPTION

Embodiments will now be described more fully with reference to the drawings. However, the exemplary embodiments can be implemented in a variety of forms and should not be construed as being limited to examples set forth herein. On the contrary, these exemplary embodiments are provided to make the present disclosure more comprehensive and complete, and fully convey the concept of the exemplary embodiments to those skilled in the art. The drawings are only schematic views of the present disclosure and are not necessarily drawn to scale. Same reference numerals in figures represent the same or similar parts, so repeated description about them will be omitted.

Although relative terms, such as "up" and "down", are used in this description to describe a relative relationship between one component and another component labeled in the drawings, these terms are used in this description only for convenience, such as according to an direction of the example described in the drawings. It can be understood that if the device labeled in drawings is turned upside down, the component described "up" will become the component described "below". When a structure is "on" another structure, it may mean that the structure is integrally formed on the another structure, or that the structure is "directly" arranged on the another structure, or that the structure is "indirectly" arranged on the another structure through other structures.

The terms "one", "a", "an", "the", "said" and "at least one" are used to indicate the existence of one or more elements/components/etc. The terms "include", "comprise" and "have" are used to mean open inclusion and mean that there may be other elements/components and the like in addition to the listed elements/components and the like.

Figure 2:
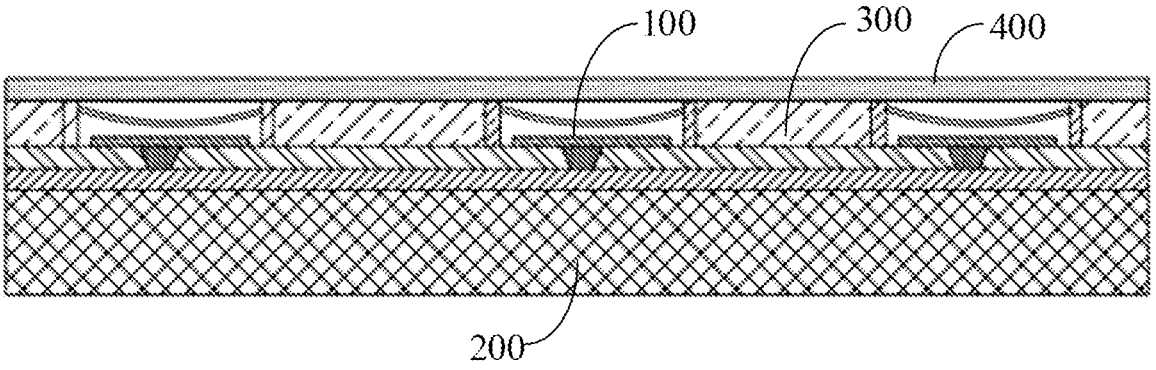
FIG. 2 is a structural schematic view of a display device provided by some embodiments of the present disclosure.
Figure 3:
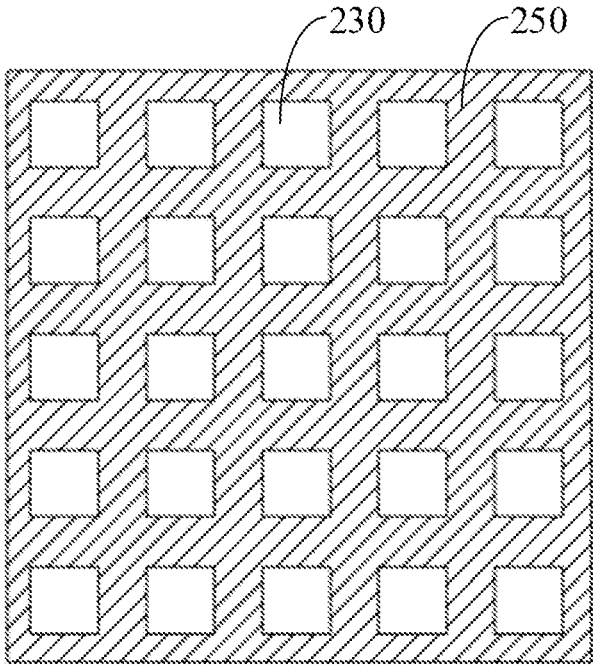
FIG. 3 is a schematic view of a first display device provided by some embodiments of the present disclosure.

As shown in FIGS. 1-3, some embodiments first provide a sound production device 100 for a display device. The display device includes a display substrate 200. The display substrate 200 has an opening area 230 and a non-opening area 250. As shown in FIG. 1, the sound production device 100 includes a first electrode layer 110, an insulating layer 130, an electromagnetic coil 150 and a magnetic diaphragm 170. The first electrode layer 110 is arranged on the display substrate 200. The insulating layer 130 is arranged on a side of the first electrode layer 110 away from the display substrate 200. The electromagnetic coil 150 is arranged on a side of the insulating layer 130 away from the first electrode layer 110, and a vertical projection of the electromagnetic coil 150 on the display substrate 200 falls on the non-opening area 250. The insulating layer 130 is provided with a via 131, and the electromagnetic coil 150 and the first electrode layer 110 are electrically connected through the via 131. That is the electromagnetic coil 150 and the first electrode layer 110 are electrically connected through conducting medium in the via 131. The magnetic diaphragm 170 is arranged on a side of the electromagnetic coil 150 away from the insulating layer 130 for vibrating and producing sound in response to a magnetic field generated by the electromagnetic coil 150, and a vertical projection of the magnetic diaphragm 170 on the display substrate 200 falls on the non-opening area 250. In some embodiments, the magnetic diaphragm 170 is spaced apart from the electromagnetic coil 150.

The sound production device 100 provided by the embodiments of the present disclosure can realize sound production inside a screen, and solve a problem that due to a large package size of the exciter and a small space under the screen, an arrangement of the exciter is difficult, and a position of the exciter is limited, making it is impossible to perform full screen sound through the electromagnetic coil 150 arranged on a driving circuit layer generates a magnetic field, and the magnetic diaphragm 170 vibrates and producing sound in response to the magnetic field generated by the electromagnetic coil 150. Peripheral devices of the screen are reduce. A structure of the sound production device 100 is simple, integration of the sound production device 100 is high, and the sound production device 100 can be arranged in a full screen to obtain better audio effect, and the combination of audio and video can be realized in the display area through UI interaction to improve the user experience.

The sound production device 100 provided by the present disclosure can be configured for a liquid crystal display device, an OLED display device, a micro LED display device, and the like. The sound production device 100 is arranged on the display substrate 200 of the display device. The display substrate 200 includes a display layer and other layers below the display layer, such as the driving circuit layer and a substrate.

FIG. 3 is a top view of a display device provided by some embodiments of the present disclosure. As shown in FIG. 3, the display device includes the opening area 230 and the non-opening area 250. For the OLED display device, the display substrate 200 refers to a OLED device layer and all layers of a display panel below the OLED device layer, that is, the sound production device 100 is arranged on a side of the OLED device layer away from the substrate. An OLED display substrate includes a pixel definition layer. The pixel definition layer is provided with an opening. An area corresponding to the opening is the opening area 230 of the display substrate 200. The opening area 230 is the pixel area. An area being free of the opening of the pixel definition layer is the non-opening area 250 of the display substrate 200.

For the liquid crystal display device, the display substrate 200 refers to a liquid crystal display layer and all layers of the display panel below the liquid crystal display layer. Generally, above the liquid crystal layer of the liquid crystal display panel is a color film layer and a black matrix layer. The sound production device 100 is arranged on a side of the black matrix layer away from the substrate. The black matrix layer is provided with an opening. An area corresponding to the opening is the opening area 230 of the display substrate 200. The opening area is a pixel area. An area being free of the opening of the black matrix layer is the non-opening area 250 of the display substrate 200.

Furthermore, the sound production device 100 provided by the embodiment of the present disclosure may also include a diaphragm packaging layer 300, a diaphragm support 190 and a sounding driving circuit 210. The diaphragm support 190 is arranged on the side of the insulating layer 130 away from the first electrode layer 110, and the magnetic diaphragm 170 is connected to the diaphragm support 190, and a vertical projection of the diaphragm support 190 on the display substrate 200 falls on the non-opening area 250. The diaphragm packaging layer 300 is arranged on the insulating layer 130 and encapsulates the electromagnetic coil 150, the diaphragm support 190 and the magnetic diaphragm 170. Specifically, the diaphragm support 190 is arranged at the outer periphery of the electromagnetic coil 150. The magnetic diaphragm 170 is arranged on a top of the diaphragm support 190. The diaphragm packaging layer 300 is arranged at the outer periphery of the diaphragm support 190 and the magnetic diaphragm 170 to encapsulate the diaphragm support 190 and the magnetic diaphragm 170. The electromagnetic coil 150 and the magnetic diaphragm 170 are encapsulated by the diaphragm packaging layer 300, and packaging of the display device is also realized. The sounding driving circuit 210 is connected to the first electrode layer 110 and the electromagnetic coil 150 for outputting an alternating driving signal. The alternating driving signal is output by the sounding driving circuit 210 to control the magnetic field intensity generated by the electromagnetic coil 150, and then control the magnetic diaphragm 170 producing sound.

Components of the sound production device 100 provided by the embodiments of the present disclosure will be described in detail below.

FIG. 2 is a schematic view of a display device provided by some embodiments of the present disclosure. As shown in FIGS. 1-2, the diaphragm support 190 is arranged on the side of the insulating layer 130 away from the first electrode layer 110, and the magnetic diaphragm 170 is connected to the diaphragm support 190. The diaphragm support 190 may be an annular structure. The electromagnetic coil 150 is arranged in the annular structure. The diaphragm support 190 is made of insulating material. The magnetic diaphragm 170 and the electromagnetic coil 150 are encapsulated by the diaphragm packaging layer 300, and there is an air gap between the magnetic diaphragm 170 and the electromagnetic coil 150. In some embodiments, the diaphragm packaging layer 300 may define a holding cavity, the electromagnetic coil 150 is arranged at a bottom of the holding cavity, and the diaphragm support 190 is arranged on a side wall of the holding cavity. The magnetic diaphragm 170 is formed on a top or the side wall of the holding cavity, and the air gap is formed by filling gas between the magnetic diaphragm 170 and the electromagnetic coil 150. A changing magnetic field generated by the electromagnetic coil 150 drives the magnetic diaphragm 170 to vibrate in the holding cavity, and different alternating driving signals are provided to the electromagnetic coil 150 according the producing sound demand, so as to make the magnetic diaphragm 170 vibrate according to a preset law and generate a target sound. It can be understood that in some embodiments, the diaphragm packaging layer 300 can be integrally formed with the diaphragm support 190, that is, the diaphragm packaging layer 300 can act as the diaphragm support 190.

In some embodiments, a filling layer may also be provided between the magnetic diaphragm 170 and the electromagnetic coil 150 to replace the air gap. In some embodiments, the diaphragm packaging layer 300 may include the holding cavity, the electromagnetic coil 150 is arranged at the bottom of the holding cavity, the magnetic diaphragm 170 is formed on the top or the side wall of the holding cavity, and the filling layer is filled between the magnetic diaphragm 170 and the electromagnetic coil 150. The changing magnetic field generated by the electromagnetic coil 150 drives the magnetic diaphragm 170 to vibrate in the holding cavity, and different alternating driving signals are provided to the electromagnetic coil 150 according to the producing sound demand, so as to make the magnetic diaphragm 170 vibrate according to the preset law and generate the target sound. During production of the sound production device 100, the magnetic diaphragm 170 is formed by vacuum evaporation, chemical deposition or sputtering and the filling layer can be formed between the electromagnetic coil 150 and the magnetic diaphragm 170, so as to facilitate the production of the magnetic diaphragm 170. The material of the filling layer may be an elastic insulating material.

A vibration intensity of the magnetic diaphragm 170 is related to a intensity of the magnetic field generated by the electromagnetic coil 150. The formula for calculating the intensity of the magnetic field generated by the electromagnetic coil 150 is $H=nI$, n is the number of turns of the electromagnetic coil 150, and I is a current on the electromagnetic coil 150. Therefore, sound production effects of different areas of the screen can be adjusted by setting a plurality of electromagnetic coils 150 with different turns and coil densities in different areas of the screen, or different currents are input to the plurality of electromagnetic coils 150 in different areas of the screen to adjust the sound production of the screen. Of course, in practical application, the magnetic field generated by the electromagnetic coil 150 can also be controlled through combination of the number of turns and the current of the electromagnetic coil 150 to control the sound production.

The sound production device 100 is arranged on a side of the display substrate 200 close to a display light output side, that is, the first electrode layer 110 is arranged above the display substrate 200. Under these circumstances, when making the display device, the sound production device 100 can be formed on the display substrate 200 first. After the sound production device 100 is packaged, planarization can be carried out, and then a protective layer can be formed. The display light output side is a display side of the display device, and an image is formed on the display light output side of the display device during display.

The first electrode layer 110 is arranged on a side of the display substrate 200 close to the display light output side. During fabrication, the sound production device 100 can be formed on the display substrate 200. The sound production device 100 is formed by forming the first electrode layer 110 on the display substrate 200 first; forming the insulating layer 130 on the first electrode layer 110; forming the electromagnetic coil 150 on the insulating layer 130; forming the diaphragm packaging layer 300 on the insulating layer 130, and then patterning the diaphragm packaging layer 300; forming the holding cavity on the diaphragm packaging layer 300, and the holding cavity being provided with the diaphragm support 190 and exposing the electromagnetic coil 150; forming the filling layer and the magnetic diaphragm 170 in the holding cavity. Alternatively, a diaphragm support 190 surrounding the electromagnetic coil 150 may be formed on the insulating layer 130 first; then, the magnetic diaphragm 170 is formed on the diaphragm support 190; finally, the diaphragm packaging layer 300 is configured to encapsulate.

The first electrode layer 110 may be formed on the display substrate 200, and the first electrode layer 110 may be formed by deposition, evaporation or sputtering. The insulating layer 130 is formed on the first electrode layer 110, the via 131 is formed on the insulating layer 130, and a conductive material is filled in the via 131. The electromagnetic coil 150 is formed on the insulating layer 130, and the electromagnetic coil 150 is electrically connected to the first electrode layer 110 through the via 131 of the insulating layer 130. Of course, in practical application, the via 131 can also be configured for the transmission of other signals between layers. The diaphragm packaging layer 300 is formed on the insulating layer 130 and encapsulates the electromagnetic coil 150. A material of the diaphragm packaging layer 300 can be an inorganic material, such as silicon nitride, and the like. A material of the diaphragm packaging layer 300 can also be an organic material, such as polyimide, and the like. The diaphragm packaging layer 300 can be formed on the display substrate 200 by deposition or sputtering. The diaphragm packaging layer 300 is patterned by photoresist and a mask plate, and etched to form the holding cavity. The holding cavity exposes the electromagnetic coil 150. The filling layer is formed in the holding cavity, and then a magnetic diaphragm 170 is formed in the holding cavity by vacuum evaporation, chemical deposition or sputtering. The magnetic diaphragm 170 is a thin film doped with magnetic components, and a thickness of the magnetic diaphragm 170 is less than or equal to 1 micron.

It can be understood that the sound production device 100 provided by the embodiments of the present disclosure can also be formed separately and then connected to a side of the driving circuit layer of the display device close to the display light output side. Under these circumstances, after the sound production device 100 is packaged separately, the sound production device 100 can be used as the packaging layer of the display device. Combining the sound production device 100 with the packaging layer of the display device can improve the integration of the display device and is conducive to lightness and thinness of the terminal. The sound production device 100 is making by forming the first electrode layer 110 first; forming the insulating layer 130 on a side of the first electrode layer 110 away from the sound production substrate; forming the electromagnetic coil 150 on the side of the insulating layer 130 away from the first electrode layer 110; forming the diaphragm support 190 and the magnetic diaphragm 170 on the side of the electromagnetic coil 150 away from the insulating layer 130 and encapsulating the above structure. A connecting pad can be arranged on the sound production device 100. The driving circuit layer can be connected through the connecting pad to realize signal transmission between the driving circuit layer and the sound production device 100.

Of course, in practical application, the sound production device 100 may also be arranged on a side of the display substrate 200 away from the display light output side. That is, the first electrode layer 110 is arranged below the display substrate 200. Under these circumstances, when making the display device, the sound production device 100 can be formed on a back of the display substrate 200. After the sound production device 100 is packaged, the sound production device 100 can be flattened.

When the first electrode layer is arranged on the side of the display substrate 200 away from the display light output side, the sound production device 100 may be by forming the first electrode layer 110 and the insulating layer 130 on the display substrate 200 during fabrication; forming the diaphragm support 190 and the electromagnetic coil 150 on the insulating layer 130; forming the magnetic diaphragm 170 on the diaphragm support 190; encapsulating the electromagnetic coil 150, the magnetic diaphragm 170 and the diaphragm support 190 by the diaphragm packaging layer 300. Alternatively, the diaphragm packaging layer 300 may be formed on the insulating layer 130. The holding cavity and the diaphragm support 190 are formed on the diaphragm packaging layer 300. The electromagnetic coil 150 and the magnetic diaphragm 170 are formed in the holding cavity.

The material of the diaphragm packaging layer 300 can be the inorganic material, such as silicon nitride, and the like. The material of the diaphragm packaging layer 300 can also be the organic material, such as polyimide, and the like. The diaphragm packaging layer 300 can be formed on the insulating layer 130 by deposition or sputtering. The diaphragm packaging layer 300 is patterned by the photoresist and the mask plate, and the holding cavity is formed by etching, and the diaphragm support 190 is formed in the holding cavity. Then, the magnetic diaphragm 170 is formed in the holding cavity by vacuum evaporation, chemical deposition or sputtering. The magnetic diaphragm 170 is the thin film doped with magnetic components, and thickness of the magnetic diaphragm 170 is less than or equal to 1 micron. When making the electromagnetic coil 150, a metal layer can be formed first, and the metal layer can be patterned to form the electromagnetic coil 150. The insulating layer 130 may be formed by deposition, and the via 131 is formed on the insulating layer 130. The via 131 is filled with conductive material, and the via 131 is configured to communicate the electromagnetic coil 150 and the first electrode layer 110. Of course, in practical application, the via 131 can also be configured for transmission of other signals between layers. The first electrode layer 110 may be formed by over deposition, evaporation or sputtering.

It can be understood that the sound production device 100 provided by the embodiments of the present disclosure can also be arranged between layers of the display substrate 200, such as between the substrate of the display substrate 200 and the driving circuit layer, or between the driving circuit layer and the display layer of the display substrate 200. The embodiments of the present disclosure are not limited thereto.

Figure 6:
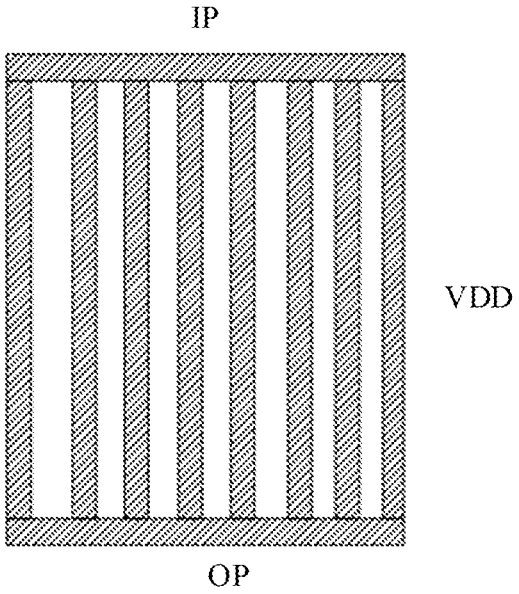
FIG. 6 is a schematic view of a pixel electrode power line routing provided by some embodiments of the present disclosure.
Figure 7:
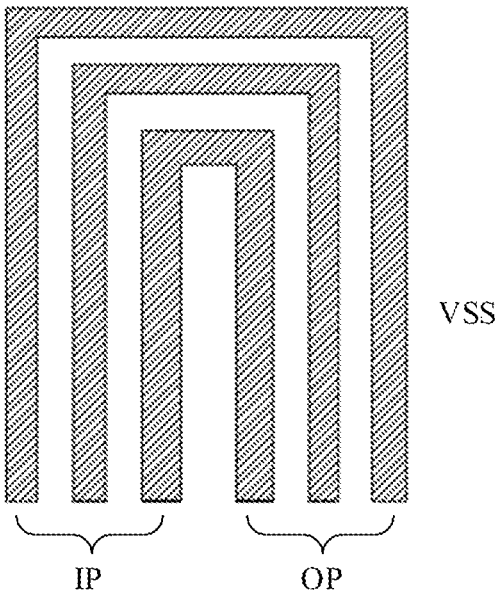
FIG. 7 is a schematic view of a first common electrode power line routing provided by some embodiments of the present disclosure.
Figure 8:
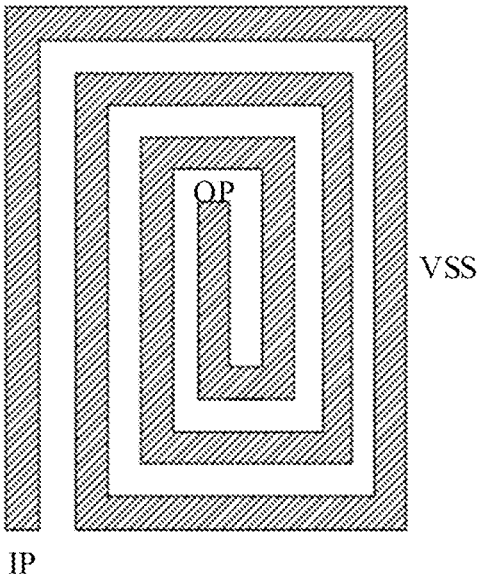
FIG. 8 is a schematic view of a second common electrode power line routing provided by some embodiments of the present disclosure.
Figure 9:
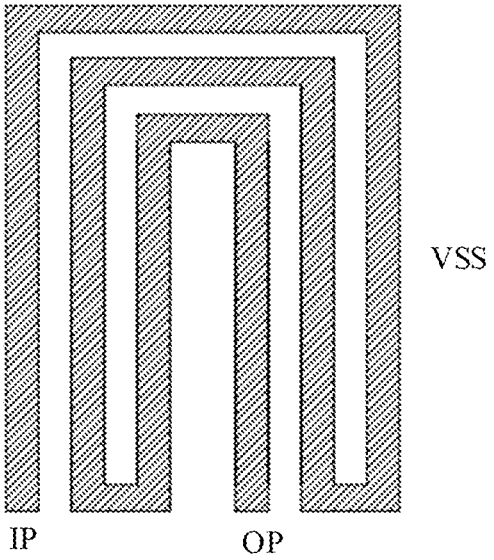
FIG. 9 is a schematic view of a third common electrode power line routing provided by some embodiments of the present disclosure.

The display substrate 200 includes a driving circuit layer, the driving circuit layer includes a pixel circuit power line, and the electromagnetic coil 150 includes a pixel circuit power line. The driving circuit layer is provided with a power line configured to supply power to a pixel circuit, and a direction of the power line can be adjusted to form the electromagnetic coil 150. As shown in FIG. 6, a routing mode of a pixel electrode power VDD line can be changed to form the electromagnetic coil 150. A pixel electrode power VDD is input from IP end and OP end. The IP end is a positive signal end and the OP end is a negative signal end. Alternatively, as shown in FIGS. 7 to 9, a routing mode of a common electrode power VSS line is changed to form the electromagnetic coil 150. FIG. 7, FIG. 8 and FIG. 9 respectively provide an example routing mode. A common electrode power VSS is input from the IP end and the op end. The IP end is a positive signal end and the OP end is a negative signal end. Multiplexing the power line of the pixel circuit and the electromagnetic coil 150 can reduce the number of signal lines of the display device, simplify the manufacturing process, and effectively reduce the thickness of the display device.

In the related art, the pixel electrode power line is arranged in a pixel circuit layer, the common electrode power line is arranged in a common electrode layer, and for the OLED display device, a OLED light-emitting layer is arranged between a pixel electrode and a common electrode. In the embodiment of the present disclosure, when the power line is used as the electromagnetic coil 150, the sound production device 100 can be arranged between the OLED light-emitting layer and the electrode layer, and a power signal of the power line can be transmitted to the light-emitting layer through the sound production device 100 through the via.

It should be noted that schematic views of the routing provided in FIGS. 6 to 9 are only illustrative and do not represent that when the common electrode power line or pixel electrode power line is used as the electromagnetic coil 150, the routing must be the way shown in the figures. In practical application, the common electrode power line or pixel electrode power line can also be in other forms. The embodiments of the present disclosure are not limited thereto.

When the power line of the pixel circuit is used as the electromagnetic coil 150, the display and sound can drive the power line of the pixel circuit time-sharing to avoid mutual interference between display and sound. When the display device displays the screen, the screen is usually displayed frame by frame. There will be an idle time between two frames. In the idle time, an alternating driving signal can be input to the electromagnetic coil 150 to drive the sound production device 100 to produce sounds. Alternatively, the display and sound can drive the power line of the pixel circuit at the same time. Under these circumstances, a selection control circuit can be set at the driving circuit layer to make the power line output two channel signals. The two channel signals are configured to drive the display and sound respectively.

In order to drive the electromagnetic coil 150 to generate the changing magnetic field, the first electrode layer 110 and the electromagnetic coil 150 are configured to receive an alternating driving signal, through holes on the first electrode layer 110, the electromagnetic coil 150 and the insulating layer 130 form a closed loop, and the alternating driving signal flows through the electromagnetic coil 150 to generate a magnetic field.

The sounding driving circuit 210 is respectively connected to the first electrode layer 110 and the electromagnetic coil 150. On the one hand, the sounding driving circuit 210 is configured to output the alternating driving signal. On the other hand, the sounding driving circuit 210 is configured to control supply of alternating driving signals to the plurality of electromagnetic coils 150. In some embodiments, the sounding driving circuit 210 may include a plurality of switch sub circuits, each electromagnetic coil 150 corresponds to a switch sub circuit, that is the plurality of electromagnetic coils are connected to the plurality of the switch sub circuits in one-to-one correspondence, the switch sub circuit is respectively connected to the alternating driving signal and a switching control signal, and the switch sub circuit is turned on in response to the switching control signal to transmit the alternating driving signal to the electromagnetic coil 150.

The switching sub circuit may include a switching transistor, such as a thin film transistor. The switching transistor includes a first end, a second end and a control end. The first end of the switching transistor is connected to the alternating drive signal, the second end of the switching transistor is connected to the electromagnetic coil 150, the control end of the switching transistor is connected to the switching control signal, and the switching transistor is turned on in response to the switching control signal to transmit the alternating drive signal to the electromagnetic coil 150.

The switching transistor provided by the embodiments of the present disclosure can be an N-type transistor or a P-type transistor, and the control end of the switching transistor can be a gate, the first end can be a source and the second end can be a drain. Alternatively, the control end of each transistor may be the gate, the first end may be the drain, and the second end may be the source. In addition, each transistor can also be an enhancement transistor or a depletion transistor. The embodiments of the present disclosure are not limited thereto.

In practical application, different areas of the display device can produce sounds by controlling conduction of switch sub circuits arranged in different areas of the display device. Sound production can be combined with displaying image. For example, when a current area of the display device displays images, the sound production device 100 in the current area can be controlled to produce sounds.

Figure 5:
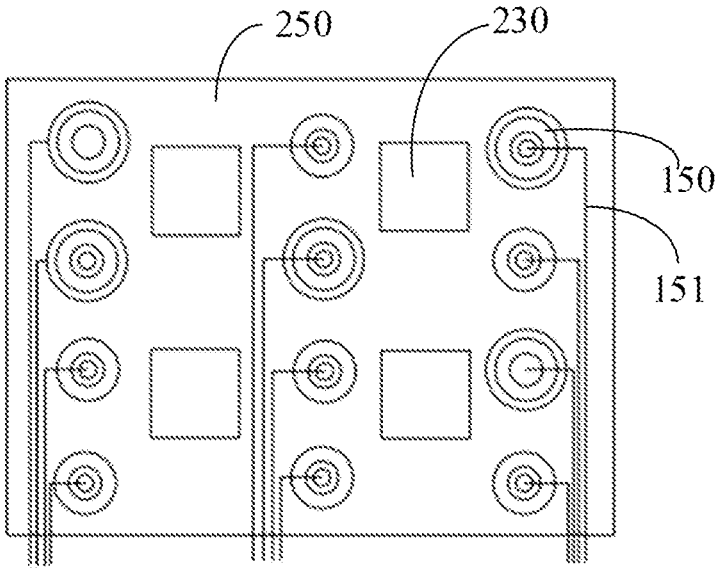
FIG. 5 is a schematic view of a distribution of an electromagnetic coil provided by some embodiments of the present disclosure.

In order to transmit the alternating drive signal to the electromagnetic coil 150, as shown in FIG. 5, the sound production device 100 provided by the embodiment of the present disclosure may also include a connecting line 151 arranged on the side of the insulating layer 130 away from the first electrode layer 110, and a vertical projection of the connecting line 151 on the display substrate 200 falls on the non-opening area 250. In this way, it can ensure that the alternating drive signal can be transmitted to the electromagnetic coil 150 without affecting the light transmission of the display device.

In order to ensure light transmittance of the display device, the first electrode layer 110 may be a transparent electrode layer and the insulating layer 130 may be a transparent insulating layer 130. For example, the first electrode layer 110 may be an ITO (indium tin oxide) layer or other transparent conductive layer. The insulating layer 130 may be a silicon nitride layer or other transparent insulating layer. The transparent electrode layer and the transparent insulating layer can ensure the light transmittance and avoid affecting the display of the display device.

It can be understood that the first electrode layer 110 can also be an opaque electrode, and the insulating layer 130 can be an opaque insulating layer 130. Under these circumstances, the vertical projection of the first electrode layer 110 and the insulating layer 130 on the display substrate 200 falls on the non-opening area, that is, openings are arranged on the first electrode layer 110 and the insulating layer 130 so that the light of the display layer can be transmitted.

The sound production device 100 provided by the embodiments of the present disclosure can realize sound production inside a screen, and solve a problem that due to a large package size of the exciter and a small space under the screen, an arrangement of the exciter is difficult, and a position of the exciter is limited, making it is impossible to perform full screen sound through the electromagnetic coil 150 arranged on a driving circuit layer generates a magnetic field, and the magnetic diaphragm 170 vibrates and producing sound in response to the magnetic field generated by the electromagnetic coil 150. Peripheral devices of the screen are reduced. A structure of the sound production device 100 is simple, integration of the sound production device 100 is high, and the sound production device 100 can be arranged in a full screen to obtain better audio effect, and the combination of audio and video can be realized in the display area through UI interaction to improve the user experience.

Some embodiments of the present disclosure also provides a display device. The display device includes the sound production device 100 described above, and the sound production device 100 is arranged on the driving circuit layer of the display device. The sound production device 100 may be arranged on the side of the driving circuit layer close to the display light output side, or on the side of the driving circuit layer away from the display light output side, or the sound production device 100 may be arranged between the driving circuit layers. The display device provided by the embodiment of the present disclosure may be the liquid crystal display device, the OLED display device, the micro LED display device, and the like.

Figure 4:
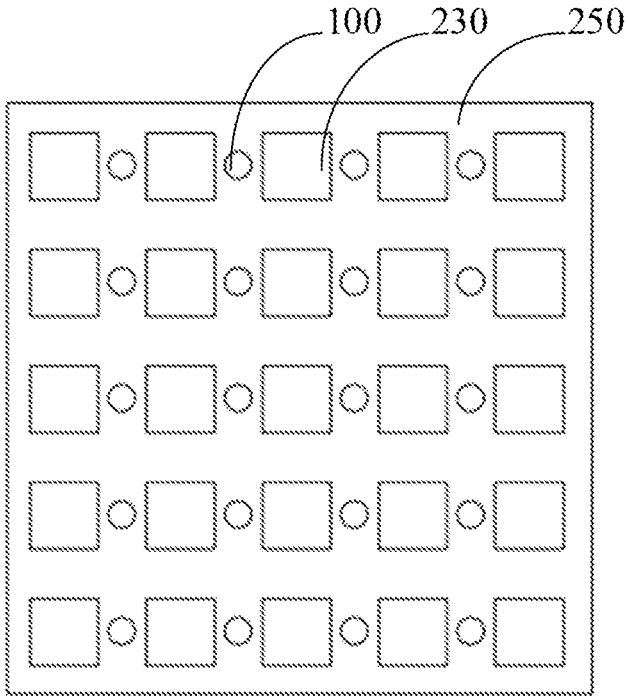
FIG. 4 is a schematic view of a second display device provided by some embodiments of the present disclosure.

FIG. 4 is a schematic top view of a display device provided by some embodiments of the present disclosure. As shown in FIG. 4, the display device includes a plurality of sound production devices 100. The plurality of sound production devices 100 are arrayed on the non-opening area 250 of the display substrate 200. Alternatively, the display device may include a plurality of sound producing areas, and the sound production devices 100 are respectively arranged on the plurality of sound producing areas. Of course, in practical application, the sound production device 100 can also be arranged on the display device in other arrangements. The embodiments of the present disclosure are not limited thereto.

In some embodiments, for the OLED display device, vertical projections of the plurality of sound production devices 100 on the display substrate 200 falls on the non-opening area 250 of the pixel definition layer and are distributed in an array on the pixel definition layer. For the liquid crystal display device, vertical projections of the plurality of sound production devices 100 on the display substrate 200 falls on the non-opening area 250 of the black matrix and are distributed in an array on the black matrix.

The plurality of sound production devices 100 may be continuously distributed on the non-opening area 250 of the display substrate 200, that is, the diaphragm supports 190 of adjacent sound production devices 100 in the plurality of sound production devices 100 contact with each other. Alternatively, the plurality of sound production devices 100 may be spaced, and distances between adjacent sound production devices 100 may be equal or unequal. The embodiments of the present disclosure are not limited thereto.

The insulating layer 130 in the sound production device 100 may be an insulating layer 130 corresponding to one sound production device 100, or the insulating layer 130 may be shared by the plurality of sound production devices 100 in the whole display device. When the plurality of sound production devices 100 share the insulating layer 130, the insulating layer 130 covers the whole display substrate 200. Under these circumstances, a plurality of vias 131 can be provided in the insulating layer 130 for transmitting various display driving signals. In some embodiments, when the plurality of sound production devices 100 are arranged on the side of the display substrate 200 close to the display light output side, the plurality of vias 131 on the insulating layer 130 can be configured to connect a source drain metal layer of the driving transistor and the pixel electrode.

Further, the display device provided by the embodiment of the present disclosure also includes a protective layer 400. The protective layer 400 is arranged on sides of the plurality of sound production devices 100 away from the display substrate 200. After the plurality of sound production device 100 are encapsulated, the protective layer 400 is formed on the sides of the plurality of sound production devices 100 away from the display substrate 200.

Figure 10:
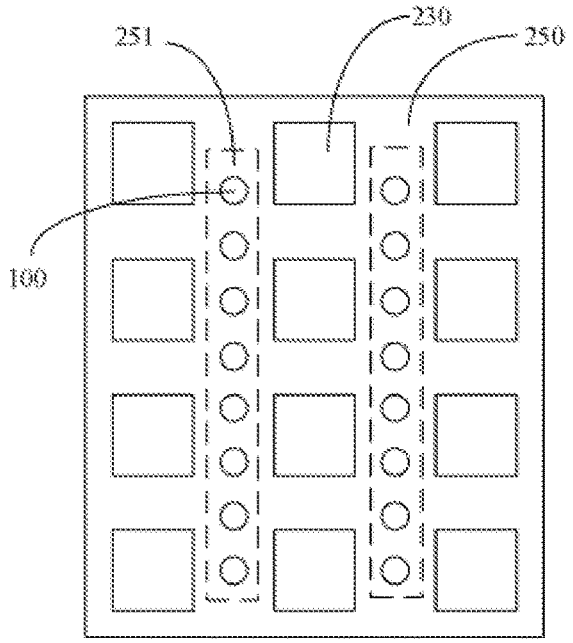
FIG. 10 is a schematic view of a third display device provided by some embodiments of the present disclosure.

As shown in FIG. 10, the non-opening area 250 of the display device includes one or more sound producing areas 251, the plurality of sound production devices 100 are arranged in the one or more sound producing areas 251, and one or more sound production devices 100 may be included in one sound producing area 251.

Figure 11:
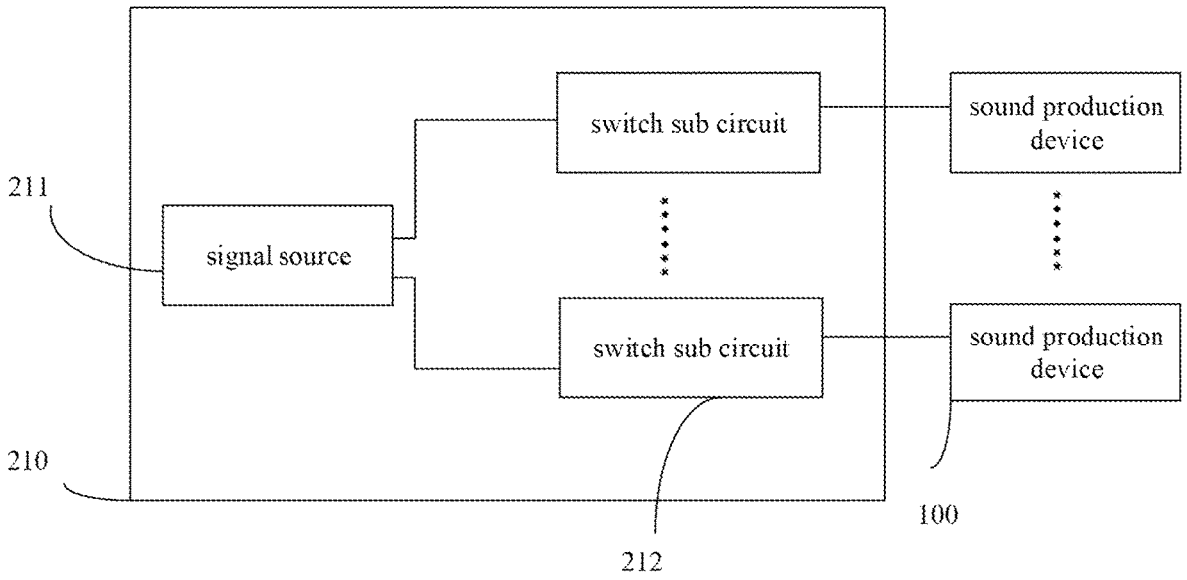
FIG. 11 is a block diagram of a display device provided by some embodiments of the present disclosure.

As shown in FIG. 11, when the display device includes a plurality of sound production devices 100, the sounding driving circuit 210 may include a signal source 211 and a plurality of switch sub circuits 212. Input ends of the plurality of switch sub circuits 212 are connected to the signal source 211, an output end of each switch sub circuit 212 is correspondingly connected to the electromagnetic coil of the sound production device 100, the control end of the switch sub circuit is connected to the switch control signal end, and a switch sub circuit is turned on in response to the switch control signal to transmit the alternating drive signal to a corresponding electromagnetic coil.

The display device provided by the embodiments of the present disclosure includes a sound production device 100. The sound production device 100 can realize sound production inside a screen, and solve a problem that due to a large package size of the exciter and a small space under the screen, an arrangement of the exciter is difficult, and a position of the exciter is limited, making it is impossible to perform full screen sound through the electromagnetic coil 150 arranged on a driving circuit layer generates a magnetic field, and the magnetic diaphragm 170 vibrates and producing sound in response to the magnetic field generated by the electromagnetic coil 150. Peripheral devices of the screen are reduced. A structure of the sound production device 100 is simple, integration of the sound production device 100 is high, and the sound production device 100 can be arranged in a full screen to obtain better audio effect, and the combination of audio and video can be realized in the display area to greatly enrich the user experience.

Figure 12:
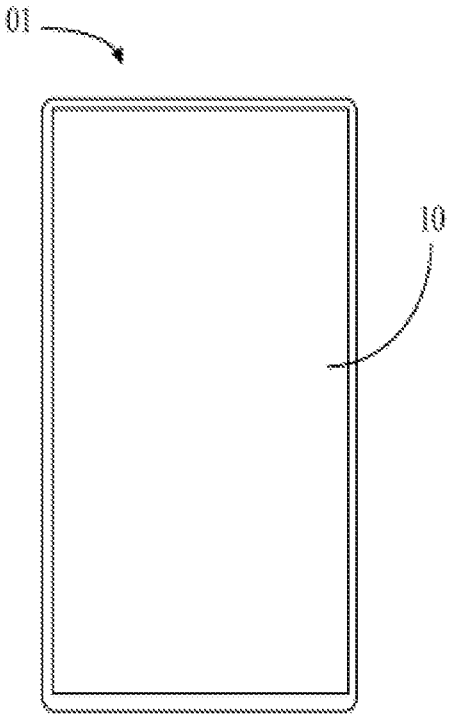
FIG. 12 is a schematic view of a terminal provided by some embodiments of the present disclosure.

Some embodiments of the present disclosure also provides a terminal 01. As shown in FIG. 12, the terminal 01 includes the above described display device 10. The terminal can be a mobile phone, a tablet computer, an e-reader, a wearable electronic device, a smart TV and other terminals.

In some embodiments, a sound production device for a display device is provided. The display device includes a display substrate. The display substrate has an opening area and a non-opening area. The sound production device includes a first electrode layer, an insulating layer, an electromagnetic coil, and a magnetic diaphragm. The first electrode layer is arranged on the display substrate. The insulating layer is arranged on a side of the first electrode layer away from the display substrate. The electromagnetic coil is arranged on a side of the insulating layer away from the first electrode layer. A vertical projection of the electromagnetic coil on the display substrate falls on the non-opening area. The insulating layer defines a via, and the electromagnetic coil and the first electrode layer are electrically connected through the via. The magnetic diaphragm is arranged on a side of the electromagnetic coil away from the insulating layer and configured to vibrate and produce sounds in response to a magnetic field generated by the electromagnetic coil. A vertical projection of the magnetic diaphragm on the display substrate falls on the non-opening area.

Alternatively, the sound production device further includes a diaphragm support arranged on the side of the insulating layer away from the first electrode layer. The magnetic diaphragm is connected to the diaphragm support, and a vertical projection of the diaphragm support on the display substrate falls on the non-opening area.

Alternatively, the diaphragm support surrounds the electromagnetic coil.

Alternatively, the sound production device further includes a diaphragm packaging layer arranged on the insulating layer and encapsulating the electromagnetic coil, the diaphragm support and the magnetic diaphragm.

Alternatively, there is an air gap between the magnetic diaphragm and the electromagnetic coil.

Alternatively, a filling layer is arranged between the magnetic diaphragm and the electromagnetic coil.

Alternatively, the first electrode layer is arranged on a side of the display substrate close to a display light output side.

Alternatively, the display substrate includes a driving circuit layer. The driving circuit layer includes a pixel circuit power line configured to supply power to a pixel circuit. The electromagnetic coil includes the pixel circuit power line.

Alternatively, the electromagnetic coil includes at least one of a pixel electrode power line and a common electrode power line.

Alternatively, the first electrode layer and the electromagnetic coil are configured to receive an alternating driving signal. The electromagnetic coil generates a magnetic field in response to the alternating driving signal.

Alternatively, the sound production device further includes a sounding driving circuit connected to the first electrode layer and the electromagnetic coil and configured to output the alternating driving signal.

Alternatively, the first electrode layer is a transparent electrode layer. The insulating layer is a transparent insulating layer.

Alternatively, a vertical projection of the first electrode layer on the display substrate falls on the non-opening area. A vertical projection of the insulating layer on the display substrate falls on the non-opening area.

In some embodiments, a display device is provided. The display device includes a display substrate having an opening area and a non-opening area and at least one sound production device. The at least one sound production device is arranged on the display substrate. Each of the at least one sound production device includes a first electrode layer, an insulating layer, an electromagnetic coil, and a magnetic diaphragm. The first electrode layer is arranged on the display substrate. The insulating layer is arranged on a side of the first electrode layer away from the display substrate. The electromagnetic coil is arranged on a side of the insulating layer away from the first electrode layer. A vertical projection of the electromagnetic coil on the display substrate falls on the non-opening area. The insulating layer defines a via, and the electromagnetic coil and the first electrode layer are electrically connected through the via. The magnetic diaphragm is arranged on a side of the electromagnetic coil away from the insulating layer, spaced apart from the electromagnetic coil and configured to vibrate and produce sounds in response to a magnetic field generated by the electromagnetic coil. A vertical projection of the magnetic diaphragm on the display substrate falls on the non-opening area.

Alternatively, the display device comprises a plurality of sound production devices. The plurality of sound production devices are arrayed on the display substrate. The non-opening area of the display device comprises a plurality of sound producing areas. The plurality of sound production devices are arranged in the plurality of sound producing areas in one-to-one correspondence.

Alternatively, the at least one sound production device is connected to a sounding driving circuit. The sounding driving circuit includes at least one switch sub circuit. The at least one switch sub circuit and the at least one sound production device have a one-to-one correspondence. Each of the at least one switch sub circuit is connected to the electromagnetic coil of a corresponding sound production device. Each of the at least one switch sub circuit turns on in response to a switch control signal and transmits the alternating driving signal to a corresponding electromagnetic coil.

Alternatively, the at least one sound production device is arranged on a side of the display substrate close to a display light output side, or on a side of the display substrate away from the display light output side, or between layers of the display substrate.

Alternatively, the insulating layer is shared by a plurality of sound production devices in response to the at least one sound production device including the plurality of sound production devices. The insulating layer covers the display substrate and a plurality of vias are provided in the insulating layer. The plurality of vias and the plurality of sound production devices are in one-to-one correspondence.

Alternatively, the display device includes a protective layer arranged on at least one side of the at least one sound production device away from the display substrate.

In some embodiments, a terminal is provided. The terminal includes a display device. The display device includes a display substrate and at least one sound production device. The display substrate has an opening area and a non-opening area. The at least one sound production device is arranged on the display substrate. Each of the at least one sound production device includes a first electrode layer, an insulating layer, an electromagnetic coil, and a magnetic diaphragm. The first electrode layer is arranged on the display substrate. The insulating layer is arranged on a side of the first electrode layer away from the display substrate. The electromagnetic coil is arranged on a side of the insulating layer away from the first electrode layer. A vertical projection of the electromagnetic coil on the display substrate falls on the non-opening area. The insulating layer defines a via, and the electromagnetic coil and the first electrode layer are electrically connected through the via. The magnetic diaphragm is arranged on a side of the electromagnetic coil away from the insulating layer, spaced apart from the electromagnetic coil and configured to vibrate and produce sounds in response to a magnetic field generated by the electromagnetic coil. A vertical projection of the magnetic diaphragm on the display substrate falls on the non-opening area.

After considering the description and practicing the invention disclosed herein, those skilled in the art will easily think of other embodiments of the present disclosure. The present disclosure aims to cover any modification, use or adaptive change of the present disclosure. Any modification, use or adaptive change of the present disclosure follows general principles of the present disclosure and includes the common general knowledge or frequently used technical means in the technical field not disclosed in the present disclosure. The description and embodiments are only considered exemplary, and the true scope and spirit of the present disclosure are indicated by the appended claims.

What is claimed is:

1. A sound production device for a display device, the display device comprising a display substrate, the display substrate having an opening area and a non-opening area, the sound production device comprising:

a first electrode layer arranged on the display substrate;

an insulating layer arranged on a side of the first electrode layer away from the display substrate;

an electromagnetic coil arranged on a side of the insulating layer away from the first electrode layer, wherein a vertical projection of the electromagnetic coil on the display substrate falls on the non-opening area, the insulating layer defines a via, and the electromagnetic coil and the first electrode layer are electrically connected through the via; and a magnetic diaphragm arranged on a side of the electromagnetic coil away from the insulating layer and configured to vibrate and produce sounds in response to a magnetic field generated by the electromagnetic coil, wherein a vertical projection of the magnetic diaphragm on the display substrate falls on the non-opening area.

2. The sound production device as claimed in claim 1, further comprising:

a diaphragm support arranged on the side of the insulating layer away from the first electrode layer, wherein the magnetic diaphragm is connected to the diaphragm support, and a vertical projection of the diaphragm support on the display substrate falls on the non-opening area.

3. The sound production device as claimed in claim 2, wherein the diaphragm support surrounds the electromagnetic coil.

4. The sound production device as claimed in claim 3, further comprising:

a diaphragm packaging layer arranged on the insulating layer and encapsulating the electromagnetic coil, the diaphragm support and the magnetic diaphragm.

5. The sound production device as claimed in claim 4, wherein there is an air gap between the magnetic diaphragm and the electromagnetic coil.

6. The sound production device as claimed in claim 4, wherein a filling layer is arranged between the magnetic diaphragm and the electromagnetic coil.

7. The sound production device as claimed in claim 1, wherein the first electrode layer is arranged on a side of the display substrate close to a display light output side.

8. The sound production device as claimed in claim 1, wherein the display substrate comprises a driving circuit layer, the driving circuit layer comprises a pixel circuit power line configured to supply power to a pixel circuit, and the electromagnetic coil comprises the pixel circuit power line.

9. The sound production device as claimed in claim 8, wherein the electromagnetic coil comprises at least one of a pixel electrode power line and a common electrode power line.

10. The sound production device as claimed in claim 1, wherein the first electrode layer and the electromagnetic coil are configured to receive an alternating driving signal, and the electromagnetic coil generates a magnetic field in response to the alternating driving signal.

11. The sound production device as claimed in claim 10, further comprising:

a sounding driving circuit connected to the first electrode layer and the electromagnetic coil and configured to output the alternating driving signal.

12. The sound production device as claimed in claim 1, wherein the first electrode layer is a transparent electrode layer, the insulating layer is a transparent insulating layer.

13. The sound production device as claimed in claim 1, wherein a vertical projection of the first electrode layer on the display substrate falls on the non-opening area, a vertical projection of the insulating layer on the display substrate falls on the non-opening area.

14. A display device, comprising:

a display substrate having an opening area and a non-opening area; and at least one sound production device, arrayed on the display substrate; wherein each of the at least one sound production device comprises:

a first electrode layer arranged on the display substrate;

an insulating layer arranged on a side of the first electrode layer away from the display substrate;

an electromagnetic coil arranged on a side of the insulating layer away from the first electrode layer, wherein a vertical projection of the electromagnetic coil on the display substrate falls on the non-opening area, the insulating layer defines a via, and the electromagnetic coil and the first electrode layer are electrically connected through the via; and a magnetic diaphragm arranged on a side of the electromagnetic coil away from the insulating layer, spaced apart from the electromagnetic coil and configured to vibrate and produce sounds in response to a magnetic field generated by the electromagnetic coil, wherein a vertical projection of the magnetic diaphragm on the display substrate falls on the non-opening area.

15. The display device as claimed in claim 14, wherein the display device comprises a plurality of sound production devices, the plurality of sound production devices are arrayed on the display substrate, the non-opening area of the display device comprises a plurality of sound producing areas, and the plurality of sound production devices are arranged in the plurality of sound producing areas in one-to-one correspondence.

16. The display device as claimed in claim 14, wherein the at least one sound production device is connected to a sounding driving circuit, the sounding driving circuit comprises at least one switch sub circuit, the at least one switch sub circuit and the at least one sound production device have a one-to-one correspondence; each of the at least one switch sub circuit is connected to the electromagnetic coil of a corresponding sound production device; and each of the at least one switch sub circuit turns on in response to a switch control signal and transmits an alternating driving signal to a corresponding electromagnetic coil.

17. The display device as claimed in claim 14, wherein the at least one sound production device is arranged on a side of the display substrate close to a display light output side, or on a side of the display substrate away from the display light output side, or between layers of the display substrate.

18. The display device as claimed in claim 14, wherein the insulating layer is shared by a plurality of sound production devices in response to the at least one sound production device comprising the plurality of sound production devices; the insulating layer covers the display substrate and a plurality of vias are provided in the insulating layer; the plurality of vias and the plurality of sound production devices are in one-to-one correspondence.

19. The display device as claimed in claim 14, further comprising:

a protective layer arranged on at least one side of the at least one sound production device away from the display substrate.

20. A terminal, comprising:

a display device, comprising:

a display substrate, the display substrate having an opening area and a non-opening area; and at least one sound production device arranged on the display substrate; wherein each of the at least one sound production device comprises:

a first electrode layer arranged on the display substrate;

an insulating layer arranged on a side of the first electrode layer away from the display substrate;

an electromagnetic coil arranged on a side of the insulating layer away from the first electrode layer, wherein a vertical projection of the electromagnetic coil on the display substrate falls on the non-opening area, the insulating layer defines a via, and the electromagnetic coil and the first electrode layer are electrically connected through the via; and a magnetic diaphragm arranged on a side of the electromagnetic coil away from the insulating layer and configured to vibrate and produce sounds in response to a magnetic field generated by the electromagnetic coil, wherein a vertical projection of the magnetic diaphragm on the display substrate falls on the non-opening area.

* * * * *